US007637692B1

(12) United States Patent
Rose

(10) Patent No.: US 7,637,692 B1
(45) Date of Patent: Dec. 29, 2009

(54) SEALED WELL CELLAR

(76) Inventor: James A Rose, 215 Maple St., Mifflinburg, PA (US) 17844

( * ) Notice: Subject to any disclaimer, the term of this patent is extended or adjusted under 35 U.S.C. 154(b) by 195 days.

(21) Appl. No.: 11/338,912

(22) Filed: Jan. 23, 2006

Related U.S. Application Data

(60) Provisional application No. 60/732,215, filed on Nov. 1, 2005.

(51) Int. Cl.
*E02B 13/00* (2006.01)

(52) U.S. Cl. ..... 405/52; 166/75.11; 166/81.1

(58) Field of Classification Search ..... 166/85.2, 166/81.1, 96.1, 75.11; 405/8, 52
See application file for complete search history.

(56) References Cited

U.S. PATENT DOCUMENTS 2,482,616 A * 9/1949 Gregory et al. ..... 166/85.1
3,202,218 A * 8/1965 Watts et al. ..... 166/356
3,236,308 A * 2/1966 Leake ..... 166/338
4,035,023 A * 7/1977 Cockrell ..... 299/17
4,125,164 A * 11/1978 Terry ..... 166/377
4,696,599 A * 9/1987 Rakoczynski et al. .... 405/129.7
4,842,443 A * 6/1989 Argandona ..... 405/52
5,098,220 A * 3/1992 Norman ..... 405/52
5,228,506 A * 7/1993 Pearce ..... 166/81.1
RE35,272 E * 6/1996 Mathieson et al. ..... 428/213
2002/0182012 A1* 12/2002 Rowe ..... 405/129.95

* cited by examiner

*Primary Examiner*—William P Neuder
*Assistant Examiner*—Sean D Andrish
(74) *Attorney, Agent, or Firm*—Richard K Thomson

(57) ABSTRACT

A well cellar system includes a substantially planar base, the base defining an aperture sized to receive a conductor pipe. The well cellar system also includes at least one substantially inflexible side member attached to the base, the at least one side member and the base defining a cavity. A seal between the at least one side member and the base substantially prevents the flow of fluids between the at least one side member and the base. The attachment between the base and the conductor pipe substantially prevents the flow of fluids between the base and the conductor. The well cellar system of the present invention substantially eliminates contamination of soil and water sources adjacent the well site during its operation.

16 Claims, 3 Drawing Sheets

SEALED WELL CELLAR

Applicant claims the benefit of provisional patent application 60/732,215 filed Nov. 1, 2005.

TECHNICAL FIELD

This invention relates to well sites, and more particularly to well cellars.

BACKGROUND

In the field of oil and gas exploration/production, a well cellar can be positioned below ground level underneath a drilling rig. Such well cellars may contain equipment such as blow out preventers, valves, and other equipment associated with drilling, completion and other well operations. The walls of the well cellar provide structural support to prevent collapse of the surrounding earth onto the equipment. The well conductor pipe extends through the well cellar into the underlying subterranean formation. During drilling, completion and other well operations, fluids from the drilling rig and production equipment, such as lubricants, drilling mud, completion fluids, and oil, can leak or spill into and out of the well cellar. These spills can create ecological problems, polluting soil samples as well as surface and subsurface aqueous sources. Such corrupted soil areas must be remediated before a well is capped, adding expense to taking a well off-line.

SUMMARY

The well cellar system of the present invention includes a substantially planar base. The base defines an aperture sized to receive a conductor pipe. At least one side member is attached to the base. The at least one side member and the base defines a cavity. Seal means between the at least one side member and the base substantially prevents flow of fluids between the at least one side member and the base. An attachment between the base and the conductor pipe substantially prevents flow of fluid between the conductor pipe and the base. This sealed well cellar eliminates soil and water pollution which is common with existing systems.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

The preferred embodiments are described in conjunction with the following drawings in which like reference numerals in the various figures indicate like elements. The drawings are not to scale as certain features are exaggerated for clarity of illustration.

DETAILED DESCRIPTION

Figure 1:
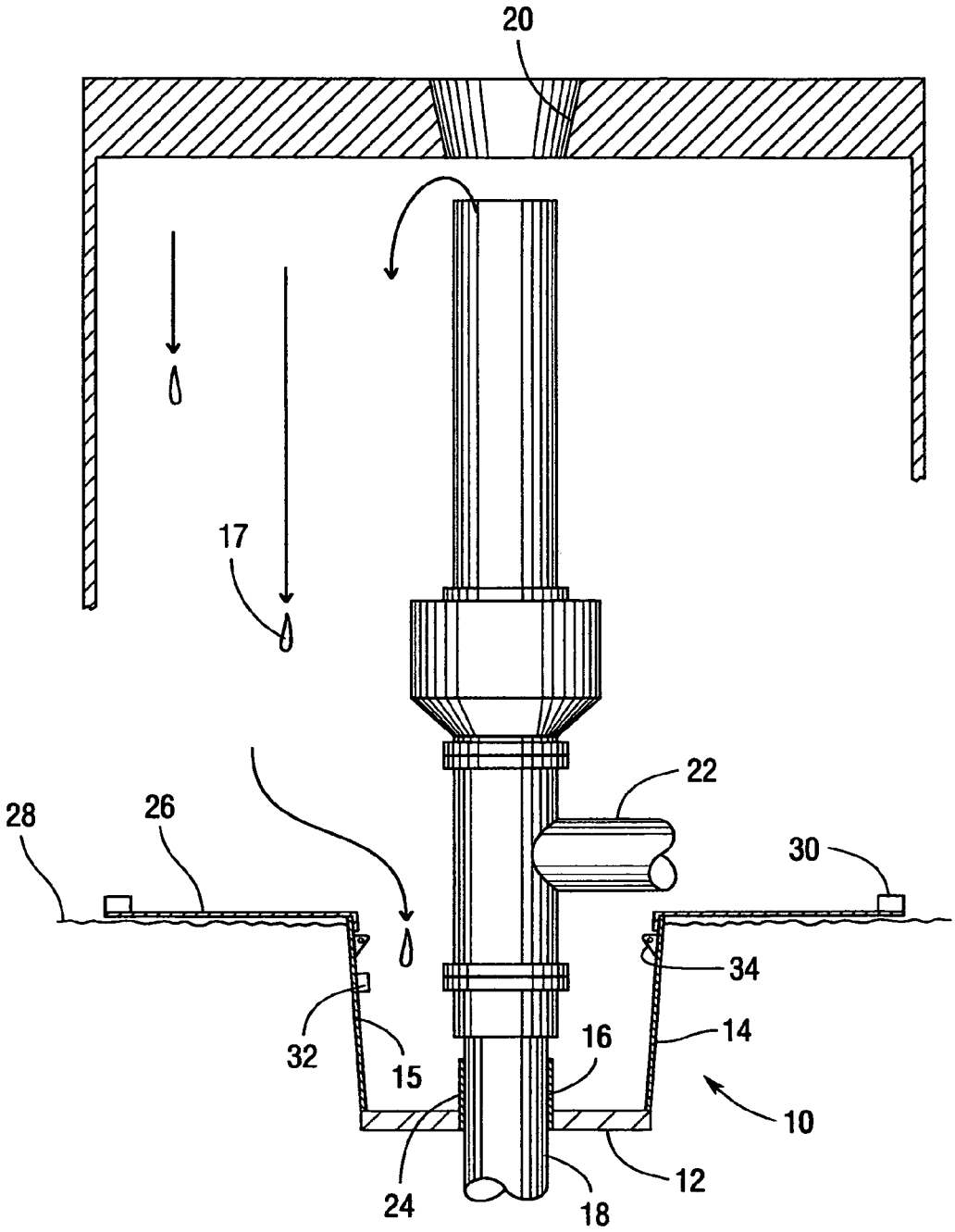
FIG. 1 is a schematic side view of a well cellar system in use.

Referring to FIG. 1, a well cellar system 10 includes a substantially planar base 12 attached to side members or walls 14. Well cellar system 10 can be disposed in an excavation where soil is removed from the ground around the well site. Walls 14 are substantially inflexible to provide structural support to prevent collapse of the surrounding earth into cavity 15 defined by base 12 and walls 14. An aperture 16 which extends through base 12 receives conductor pipe 18. In this instance, conductor pipe 18 is attached to piping 22 which can be, for example, diverter piping. In some instances, valves, blow out preventers, and other equipment associated with drilling and/or completion operations are disposed in cavity 15. Some embodiments include a riser 24 attached to base 12 around aperture 16 that extends substantially concentrically around conductor pipe 18. The riser 24 may attach and, in some instances seal or substantially seal, to the conductor pipe 18.

As used herein, the term conductor pipe is used to indicate a conductor pipe, riser pipe, surface casing, or other tubular member installed at or about the ground surface. As is discussed in more detail below, the seal between base 12 and walls 14 prevents or substantially prevents the flow of fluids between the at least one side member 14 and the base 12. Likewise, the seal between the base 12 and the conductor 18 prevents or substantially prevents the flow of fluids between the conductor pipe 18 and base 12. Fluids 17 from drilling rig 20, such as lubricants, drilling mud, stimulation fluids, and oil, can leak or spill into cavity 15. Sealing or substantially sealing the flow of such fluids out of cavity 15 can limit leakage into and contamination of the earth adjacent cavity 15. Avoiding this contamination eliminates costly cleanup of soil and water surrounding the site.

In some instances, a fluid impermeable liner 26 is attached to walls 14 and extends radially outward and laterally across the ground surface 28. Liner 26 may be clamped (see hoop-shaped clamp 27, FIG. 2) to the perimeter of walls 14. In some instances, a sealing compound, glue or gasket can be used to ensure a seal between liner 26 and walls 14. A berm 30 can be placed around the outer edges of impermeable liner 26 to contain fluids leaking onto the impermeable liner. Impermeable liner 26 can be manufactured of polymer sheet materials. In some instances, ground surface 28 and impermeable liner 26 are sloped towards cavity 15. This tends to direct fluids leaking onto impermeable liner 26 to cavity 15 which can act as a sump for the collection of the fluids. Berm 30 can be an integral part of impermeable liner 26. In some instances, berm 30 is sealed to liner 26 to prevent leakage between the berm 30 and the liner 26.

For some applications, a fluid level sensor can be installed to monitor the level of fluids in cavity 15. In this instance, a high level alarm sensor switch 32 is mounted on wall 14 and triggered when contacted by fluids in cavity 15. A float sensor could alternatively be used. Other fluid level sensors include, for example, a pressure based sensor that monitors the level of fluids in cavity 15 on an ongoing basis (as opposed to high level alarm sensor switch 32 which is only activated when the fluids in the cavity reach a pre-set level). Data from such sensors can be used as input for controllers operating appropriate pumps (not shown) that can be installed to remove fluids from cavity 15. Such pumps can be permanently installed or temporarily installed as needed.

Padeyes 34 are mounted on walls 14. Padeyes 34 can be used in removal of well cellar system 10 or components thereof from the surrounding earth after the well cellar system is no longer desired, for example by attaching an appropriate piece of heavy machinery such as, for example, a backhoe to padeyes 34 and simply pulling walls 14 (or the entire well cellar system 10) out of the earth. Padeyes 34 may also be used during installation of cellar 10 for assisting in placing the cellar 10 into the cavity in the earth, holding upright during back-filling, etc.

Figure 2:
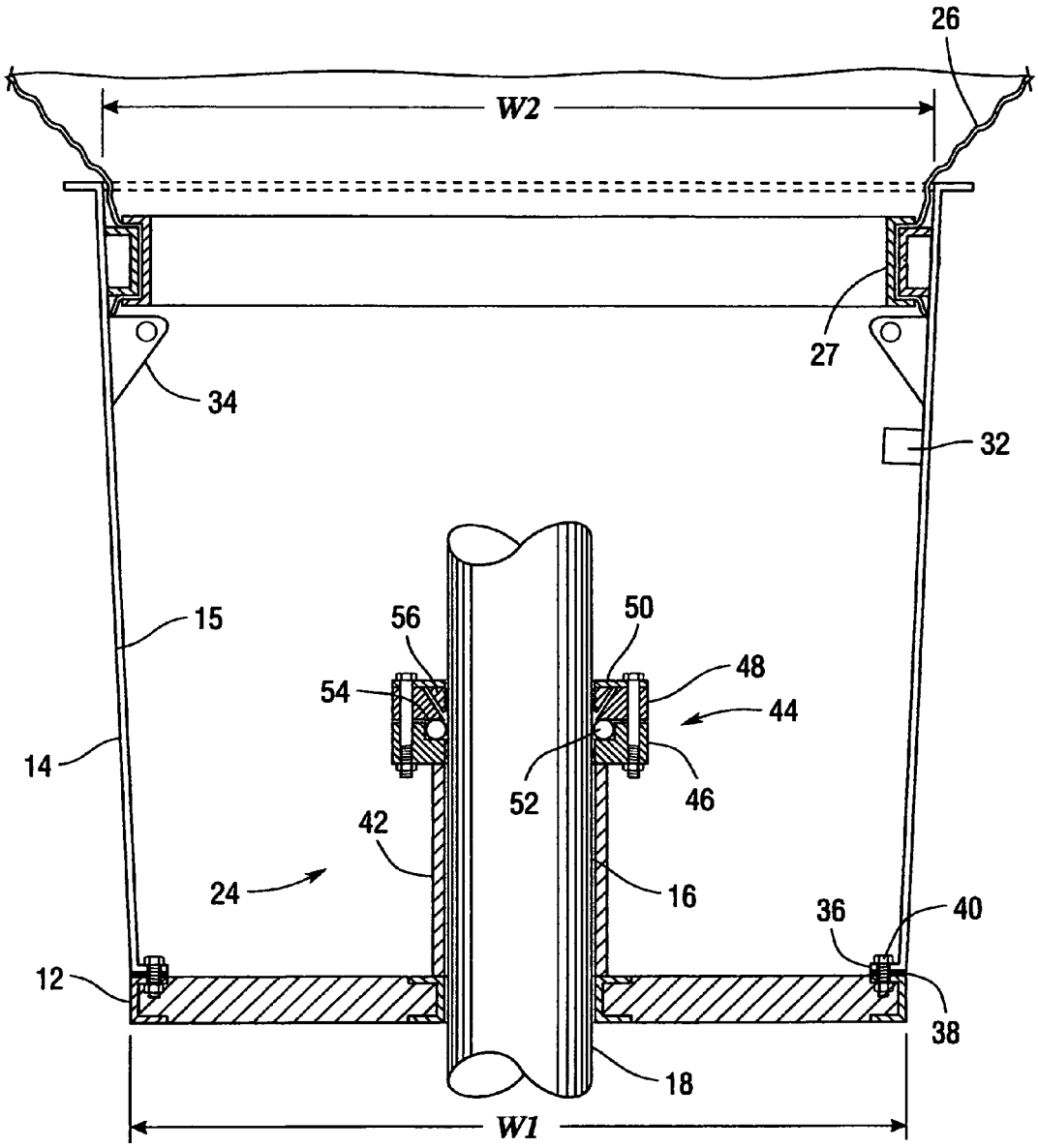
FIG. 2 is a detail cross-sectional view of an alternate well cellar system.

Referring to FIG. 2, cavity 15 has a width $W_1$. As used herein, width $W_1$ is the diameter of the pipe when the walls 14 are formed by a pipe. In some instances, a width $W_1$ measured at base 12 is smaller than a width $W_2$ measured at the open end of cavity, so that the walls 14 slope inward toward the base 12. The inwardly sloping walls 14 aid in removing the well cellar system 10 from the earth, because when the well cellar system 10 is lifted vertically up from the excavation, the walls 14 come out of contact with the surrounding earth. In this embodiment, walls 14 are formed with a width (diameter) $W_2$ of about 60 inches (152.4 cm) at the open end of the cavity and a width (diameter) $W_1$ of about 58 inches (147.3 cm) at the base 12. Other dimensions of $W_1$ and $W_2$, as well as $W_1$ and $W_2$ being equal, are within the scope of the invention. For example, in areas subject to permafrost and thawing, it may be desirable for $W_1$ and $W_2$ to be equal to prevent post jacking of the well cellar system 10.

As noted above, FIG. 2 depicts walls 14 formed by a section of pipe attached to base 12, the walls and base defining a cylindrical or substantially cylindrical cavity 15. Appropriate pipe includes, for example, corrugated culvert pipe. In other embodiments, walls 14 can be rectangular sheets attached to base 12, the walls and base defining a cavity with a square, rectangular, or other polygonal footprint. Similarly, base 12 and walls 14 can be formed of materials including, for example, steel, aluminum, polymer, polymer reinforced composite, and other materials that provide the necessary structural support and impermeability. It is contemplated that the best mode could take the form of a molded plastic barrel with an opening 16 with means to seal base 12 to the conductor pipe 18.

In some embodiments, walls 14 include a flange 36 extending radially inward from an edge of walls 14 adjacent base 12. A gasket 38 is disposed between base 12 and flange 36 with both the flange and the gasket extending substantially around the outer perimeter of the base. The gasket 38 seals or substantially seals walls 14 to base 12. In other embodiments, flange 36 and gasket 38 are replaced by an alternate sealing mechanism such as, for example, a perimeter weld or a bead of polymer sealant. In some embodiments, walls 14 are bolted to base 12 using bolts 40 that extend through flange 36 into the base 12. Bolts 40 may optionally be configured to fail (i.e., be frangible) thus allowing the detachment of walls 14 from base 12 to leave base 12 in place when wall 14 and other components of the well cellar system 10 are removed from the excavation. Higher strength bolts 40 may be included together with the frangible bolts 40 to support base 12 during installation.

After installation, the higher strength bolts 40 or their respective nuts may be removed, so that walls 14 and base 12 are attached only by the frangible bolts 40.

In some embodiments, riser 24 is sealingly attached by welding, gluing or other mechanical attachment to affix it to conductor pipe 18. Riser 24 can attach to the conductor pipe 18 in other manners. For example, riser 24 can include riser walls 42 extending around the aperture substantially perpendicular to base 12 and a riser collar 44. Riser collar 44 includes a gasket ring 46, a slip segment ring 48, and a cover ring 50 which are annular in shape and sized to receive conductor pipe 18. Gasket ring 46, slip segment ring 48, and cover ring 50 are bolted together.

Gasket ring 46 includes a shoulder which supports a ring gasket 52 in a recess that is partially defined by a surface 54 of slip segment ring adjacent the gasket ring. Wedge shaped slip segments 56 are disposed against the inner surface of slip segment ring 48 such that as the bolts holding gasket ring 46, slip segment ring 48 and cover ring 50 are tightened, slip segments 56 move radially inward to grip conductor pipe 18. Ring gasket 52 seals or substantially seals between riser 24 and conductor pipe 18 and prevents the flow of fluids out of cavity 15 into the surrounding earth even if the fluids rise above the top of the riser 24.

In another example, in some embodiments, a bradenhead, "A" section, wellhead, or starting head can be welded or otherwise affixed to base 12 or riser 24. In such embodiments, the slips and sealing functions are provided by the bradenhead, "A" section, wellhead or starting head. In another example, base 12 may omit the riser 24 and can incorporate gasket ring 46, slip segment ring 48, cover ring 50, slip segments 56 and ring gasket 52 or similar sealing and gripping mechanism. In alternate embodiments, riser 24 may exclude ring gasket 52, segment ring 48 and cover ring 50 and be welded or otherwise sealingly affixed to conductor pipe 18 after the conductor pipe is inserted through the riser and opening 16 in base 12. In alternate embodiments, base 12 may omit riser 24 be welded or otherwise sealingly affixed to conductor pipe 18. In such embodiments, the weld or other sealing material prevents the flow of fluids out of cavity 15 between the conductor pipe and well cellar system 10. In yet other embodiments, riser 24 can be sealingly affixed to conductor pipe 18 with a clamp mechanism (not shown).

As noted, riser 24 can be welded or otherwise sealingly affixed to base 12. Riser 24 can receive conductor pipe 18 to laterally and vertically support conductor pipe 18 and equipment attached thereto. Base 12 can be reinforced with I, L, C, boxed or other shaped channel or tubing to increase stiffness in and out of the plane of base 12. Gussets (not specifically shown) may be provided between riser 24 and base 12 to further increase stiffness. In many instances, it is desirable to leave an annular space between riser 24 or base 12 and conductor pipe 18 to allow for passage and/or circulation of fluids such as water, drilling mud (sometimes including cuttings), cement or other fluids during installation of the conductor pipe before the seal is made. The annular space may be subsequently sealed, for example, as provided herein.

Figure 3:
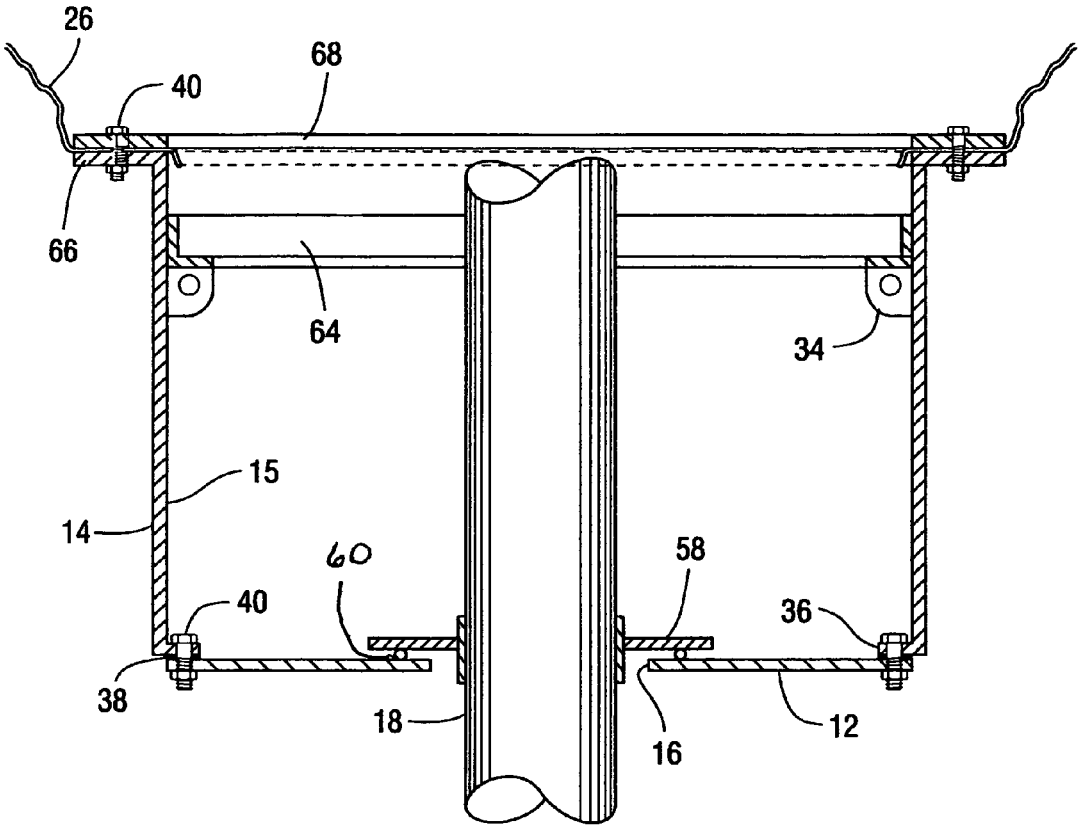
FIG. 3 is a schematic side view of an alternate well cellar system.

Referring to FIG. 3, riser 24 may be omitted and a flanged fitting 58 may be provided and sealed to conductor pipe 18. Flanged fitting 58 compresses an aperture seal member 60 against base 12 to seal or substantially seal the flow of fluids out of cavity 15 between the conductor pipe and well cellar system 10. Flanged fitting 58 may be welded to conductor pipe 18 also providing a seal. Similarly, in some alternate embodiments, both flanged fitting 58 and riser 24 are omitted and conductor 18 is welded directly to base 12.

Attaching base 12 to conductor pipe 18, either directly or via riser 24, provides vertical support to conductor pipe 18 and attached equipment to reduce, and in some instances, prevent settling of conductor pipe 18 under vibration and its own weight. Further, as depicted in FIG. 3, a hoop-shaped angle iron 64 can be welded, or otherwise affixed to, interior surface of wall 14 to provide a support for a work surface which may be subsequently installed, as needed. Upper edge of wall 14 may be formed with outwardly extending flange 66 to facilitate attachment of liner 26 by bolting ring 68 thereto sandwiching liner 26.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A well cellar system adapted to collect spilled well fluids around a conductor pipe, said well cellar comprising:

a) a planar base for insertion into a hole to sit below ground level, said base including an aperture sized to receive the conductor pipe;

b) at least one side member attached to the base, said at least one side member and said base defining a cavity, said at least one side member being fluid impermeable and including a vertically extending wall which supports lateral sides of an excavation into which it is inserted;

c) seal means between said planar base and said at least one side member;

whereby said seal means prevents flow of the fluids between said at least one side member and said base;

d) at least one padeye affixed to said cylindrical wall permitting heavy machinery to be attached to said well cellar enabling said well cellar to be removed from the hole once the well's useful life has been completed;

e) second seal means between said base and the conductor pipe to prevent the flow of fluids between said base and the conductor pipe.

2. The well cellar system of claim 1 wherein said vertically extending wall tapers inwardly from a top edge extending toward said base.

3. The well cellar system of claim 2 wherein said at least one side member is formed integrally with said planar base.

4. The well cellar system of claim 2 wherein a) said base has sufficient breadth and, b) said second seal means has sufficient integrity, to support the conductor pipe and equipment associated therewith resisting settling of the conductor pipe into the excavation.

5. The well cellar system of claim 4 wherein said second seal means further comprises a riser attached to said base, said riser extending around said aperture perpendicularly to said base.

6. The well cellar system of claim 5 wherein said riser is adapted to be sealingly attached, as by welding, gluing or other mechanical attachment, to the conductor pipe after the conductor pipe has been inserted through said riser and said aperture in said base.

7. The well cellar system of claim 5 wherein said riser comprises a mechanical device adapted to grip the conductor pipe when the conductor pipe is inserted through the riser and said aperture in said base.

8. The well cellar system of claim 4 further comprising a flanged fitting which compresses an aperture seal member to prevent the fluid flow between said base and the conductor pipe.

9. The well cellar system of claim 2 wherein said at least one side member comprises a flange extending from an edge of said at least one side member.

10. The well cellar system of claim 9 wherein a plurality of bolts extend through said flange into said base, and said bolts are adapted to fail and release said base from said at least one side member when said well cellar system is lifted from the excavation.

11. The well cellar system of claim 1 further comprising a drip liner attached to extend radially outwardly from said at least one side member.

12. The well cellar system of claim 1 further comprising a level alarm mounted within said cavity.

13. The well cellar system of claim 1 wherein the aperture is sized to define an annulus about the conductor pipe, the annulus adapted to allow passage of the fluids during conductor pipe installation and be sealed thereto thereafter.

14. The well cellar system of claim 1 further comprising at least one ledge attached to at least a portion of an internal surface of said at least one side member for supporting a work surface.

15. The well cellar system of claim 1 further comprising a) fluid-impermeable drip liner means for capturing fluids dripping from the conductor pipe outside a maximum diameter of an upper edge of said wall, said fluid-impermeable drip liner means extending outwardly beyond said maximum diameter overlying the surface of the ground surrounding the well, said fluid-impermeable drip liner means conforming to a surface configuration of a ground portion upon which it lies and being fluid impermeable, funneling any of said fluids falling thereon into said confinement member, b) a berm sealingly secured to an outer peripheral edge portion of said fluid-impermeable drip liner means to prevent the captured fluids from running off said peripheral edge portion.

16. The well cellar system of claim 15 further comprising means to sealingly attach said fluid-impermeable drip liner means to said upper edge of said confinement member.

* * * * *